United States Patent [19]

Ozaki et al.

[11] 4,036,736

[45] July 19, 1977

[54] PROCESS FOR PRODUCING SYNTHETIC COKING COAL AND TREATING CRACKED OIL

[75] Inventors: Hiromi Ozaki, Urawa; Mamoru Yamane, Tokyo; Haruo Yoshikai; Hachio Kodama, both of Toda, all of Japan

[73] Assignee: Nippon Mining Co., Ltd., Tokyo, Japan

[21] Appl. No.: 666,309

[22] Filed: Mar. 12, 1976

Related U.S. Application Data

[63] Continuation-in-part of Ser. No. 583,698, June 4, 1975, abandoned, which is a continuation of Ser. No. 428,412, Dec. 26, 1973, abandoned.

[30] Foreign Application Priority Data

| | | |
|---|---|---|
| Dec. 22, 1972 | Japan | 47-128176 |
| July 2, 1973 | Japan | 48-73676 |
| Dec. 14, 1973 | Germany | 2362252 |
| Dec. 21, 1973 | France | 73.45985 |

[51] Int. Cl.[2] ..... C01G 9/36

[52] U.S. Cl. ..... 208/106; 208/128; 208/131; 423/445

[58] Field of Search ..... 208/46, 106, 127, 131, 208/128

[56] References Cited

U.S. PATENT DOCUMENTS

| | | | |
|---|---|---|---|
| 3,475,323 | 10/1969 | Stuckey et al. | 208/97 |
| 3,547,804 | 12/1970 | Noguchi et al. | 208/46 |
| 3,956,101 | 5/1976 | Hara et al. | 208/130 |

*Primary Examiner*—Herbert Levine
*Attorney, Agent, or Firm*—Oblon, Fisher, Spivak, McClelland & Maier

[57] ABSTRACT

Synthetic coking coal is produced by coking heavy hydrocarbons at a temperature greater than the temperatures which initiate cracking in the coker, and by removing the gaseous and liquid products from the coker at accelerated velocities. The thermally cracked oil produced in the coking reaction can be hydrodesulfurized to produce a low sulfur fuel oil.

9 Claims, 2 Drawing Figures

PROCESS FOR PRODUCING SYNTHETIC COKING COAL AND TREATING CRACKED OIL

CROSS-REFERENCE TO RELATED APPLICATIONS

This application is a continuation-in-part of application Ser. No. 583,698, filed June 4, 1975, and now abandoned which application is a continuation of application Ser. No. 428,412, filed Dec. 26, 1973, now abandoned.

BACKGROUND OF THE INVENTION

1. Field of the Invention

The present invention relates to a process for producing a synthetic coking coal which is used as a source of coal for producing a blast furnace coke by coking heavy hydrocarbons such as atmospheric residual oil or vacuum residual oil under the coking conditions of reduced partial pressure or reduced total pressure. More particularly, the present invention relates to a process for producing a low sulfur fuel oil by hydrodesulfurization of the thermally cracked oil which is formed in the coking reaction in high yield.

2. Description of the Prior Art

Recently, difficulties have been encountered in obtaining adequate supplies of coal for producing blast furnace coke because of the shortage of coal. Thus, alternative sources of coke such as the coke produced by coking a petroleum residual oil fraction has been used as the source of a portion of the coal required for producing metallurgical coke in many blast furnaces applications. However, the conventional coke produced by coking a petroleum residual oil fraction (delayed coking, fluid coking, etc.) has inferior coking properties and low fluidity. These factors have limited the amounts of this type of coke which have been blended with other cokes. Accordingly, this type of coke has only been used as a low ash content carbon source.

The thermally cracked oil obtained by the coking of residual oils contains a substantial low boiling fraction and only a small amount of a high boiling fraction.

Another factor which has influenced the use of residual oils is the increased amount of pollution caused by the sulfur dioxide liberated by the increased consumption or combustion of heavy fuel oil. Thus, it has been necessary to thoroughly treat vacuum residual oils having high sulfur contents which are produced as a by-product in refinery operations.

A need, therefore, exists for a synthetic coking coal having good coking properties and fluidity which is used as a raw material for blast furnace coke and which is produced from a thermally cracked residual oil. The cracked oil is produced in high yield, and is hydrosulfurized to produce a low sulfur fuel oil.

SUMMARY OF THE INVENTION

Accordingly, one object of the invention is to provide a process for producing a synthetic coking coal havng good coking properties and fluidity from heavy hydrocarbons such as petroleum vacuum residual oil, which is used as a raw material for blast furnace coke having substantial stiffness.

Another object of the invention is to provide a process for producing a low sulfur fuel oil from thermally cracked oil. Briefly, these objects and other objects of the invention as hereinafter will become more readily apparent can be attained by a process for producing synthetic coking coal by coking heavy hydrocarbons at a temperature greater than the temperatures which initiate cracking in the coker, wherein the improvement comprises removing the gaseous and liquid products from the coker at accelerated velocities. The thermally cracked oil produced in the coking reaction can be hydrodesulfurized to produce a low sulfur fuel oil.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
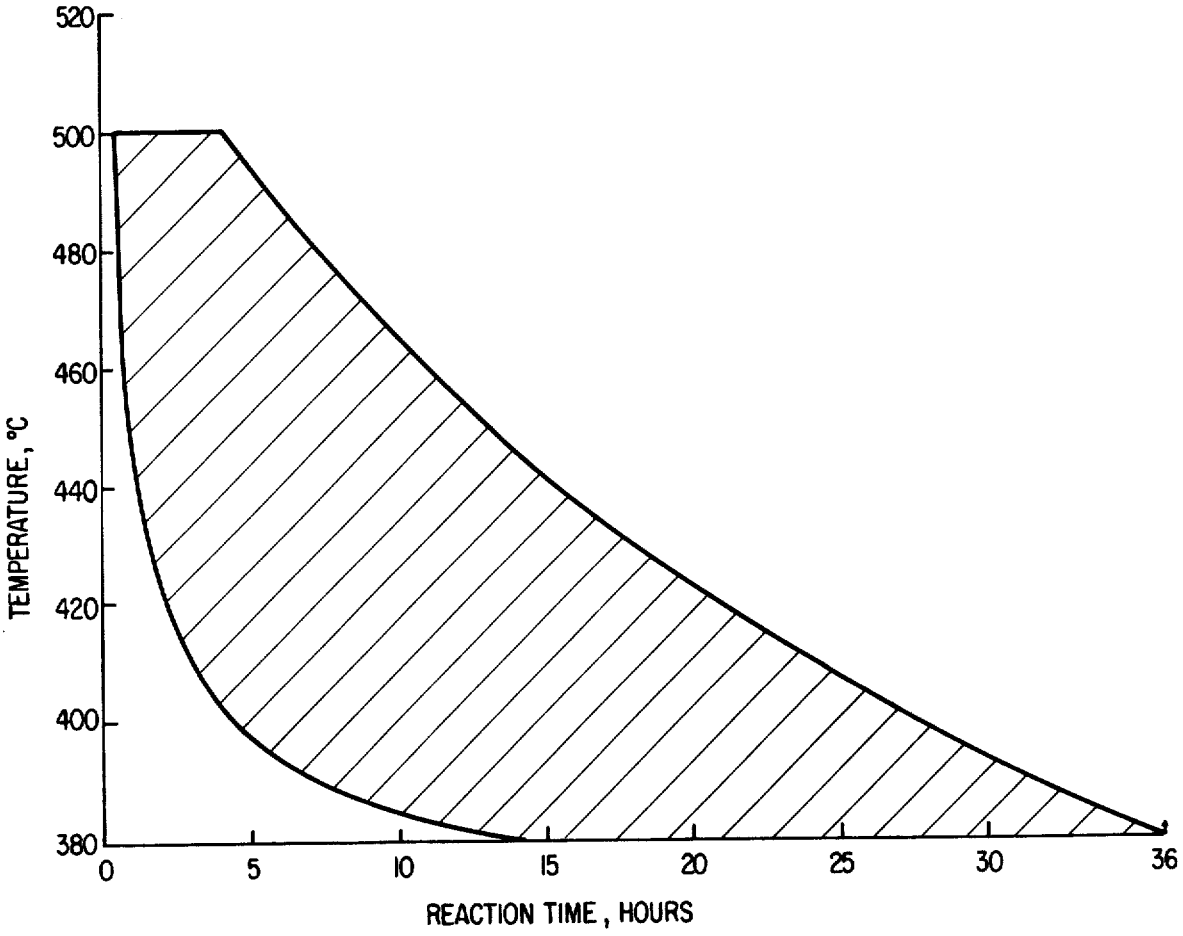
FIG. 1 shows the time-temperature relationship.

The important feature of the invention is achieved by conducting the coking reaction, and removing the resulting materials as gas and liquids at accelerated velocities under reduced partial pressures of the cracking product induced by an inert gas flow (nitrogen, water, steam or the like) and/or a hydrocarbon gas from the coker. It is also possible to reduce the partial pressure of the cracking product by operating at reduced total pressure, that is, under a vacuum. In the conventional method of coking, the atmosphere within the coker or reactor is maintained under stable and constant conditions. The conventional methods have used steam which is injected into the feed pipe before the furnace in order to prevent precipitation of coke in the pipe of the furnace. With the conventional steam injection techniques, no improvement in the coking properties can be expected, and the resulting thermally cracked oil contains only a small high boiling fraction.

In the coking process, it has been known to recycle the heavy oil fraction of the resulting thermally cracked oil with or without further thermal cracking. The recycling of the heavy oil fraction is used to obtain light distilled oils and/or to improve the quality of needle coke. On the other hand, no known coking procedures use the passage of an inert gas or a gaseous hydrocarbon stream in the coking process. The coke produced in the conventional processes has no coking properties. On the other hand, the synthetic coking coal produced by the process of the invention has very good coking properties and fluidity which makes it excellent as a feed stock for blast furnace coke. (This type of coke cannot be obtained by the conventional coking process.) The coke of the present invention is produced by decreasing the partial pressure of the hydrocarbon vapor formed upon thermal cracking of the heavy hydrocarbons by conducting the coking reaction under a reduced partial pressure induced by a flow of inert gas or hydrocarbon gas or a mixture thereof. The process has also succeeded in producing thermally cracked oil having a high boiling fraction in high yields, which contains smaller amounts of olefins than the light fractions. The process also eliminates metals and asphaltenes which can be converted very easily to low sulfur fuel oil by hydrodesulfurization. Accordingly, the industrial significance of the invention is substantial.

The coking reaction is conducted at a reduced partial pressure of the cracking product, preferably, it is conducted at a partial pressure of from 600 - 50 mm Hg, especially 500 - 50 mm Hg (absolute pressure) in order to improve the properties of the thermally cracked oil and the synthetic coking coal. The pressure selected is dependent upon the properties of the crude oil. For example, the coking of vacuum residual oil from Kuwait crude oil under a pressure of 200 mm Hg provides a thermally cracked oil which has a boiling point higher than 300° C and which contains no metals or asphaltenes in yields of 55% based on the residual oil. The residual oil also provides a synthetic coking coal which has excellent coking properties with a free-swelling index (measured by ASTM Designation D720-57) of 7½, a maximum fluidity temperature of 420° C and a maximum fluidity greater than 28,000 ddpm. The coking coal also has a softening temperature of 312° C, a solidification temperature of 510° C (measured by ASTM Designation D1812-60), a volatile matter content of 24.6% (measured by JIS M8812-1972) and is obtained in yields of 29% based on the residual oil.

When coking under reduced partial pressures induced by a gas flow, it is preferable to use a gas flow rate higher than 5 l/hr - kg of heavy hydrocarbon (Standard Temperature and Pressure) when nitrogen gas is introduced. The coking properties of the synthetic coking coal are improved, and also the amount of the heavy oil fraction produced which has a boiling point higher than 300° C in the cracked oil increases with increased gas flow rates. The preferred gas flow rate depends upon the properties of the feed stock and is preferably from 30–500 l/hr-kg of feed stock.

When the feed stock has a high content of condensed aromatic ring compounds, a synthetic coking coal having very good coking properties can be obtained at relatively low gas flow rates. On the other hand, when the heavy oil contains a low content of condensed aromatic ring compounds, the coking reaction should be conducted at a relatively high gas flow rate in order to obtain the desired results of the invention. For example, when a thermally cracked oil produced as a by-product in the naphtha cracking process is used as a feed stock, the content of condensed aromatic ring compounds is high which results in a synthetic coking coal having good coking properties even though the gas flow rate is lower than 15 l/hr - kg feed stock (Standard Temperature and Pressure). On the other hand, when the vacuum residual oil is used as a feed stock in the coking reaction under nitrogen gas flow at a rate of 45 l/hr - kg feed stock (Standard Temperature and Pressure), 46.5% of the thermal cracked oil having boiling point higher than 300° C and 32% of the synthetic coking coal having free swelling index of 5½ are obtained.

When gaseous hydrocarbons are used in the coking process, they have the same effect as the inert gas. The synthetic coking coal produced in the presence of gaseous hydrocarbons which has good coking properties can be obtained by a gaseous flow of hydrocarbons at a rate which corresponds to the flow rate of the inert gas.

The coking reaction temperature of the invention can be in the range of about 410° - 490° C, which is the same temperature ranges employed in conventional delayed coking processes. Moreover, it is possible to lower the lower limit of the coking reaction temperature range to the temperature at which initiation of the cracking of feed stocks occurs, for example, 380° C for Kuwait vacuum residual oil. This has the advantage of preventing coke deposition in the furnace tubes which causes trouble in the operation of the conventional coking process. The upper limit of the temperature is not cirtical and can be higher than 500° C. However, temperatures of this order can result in the deposition of coke in the tubes of the reactor and other similar difficulties. Accordingly, the temperature of coking can be from 380° - 500° C, preferably 400° - 460° C.

Figure 2:
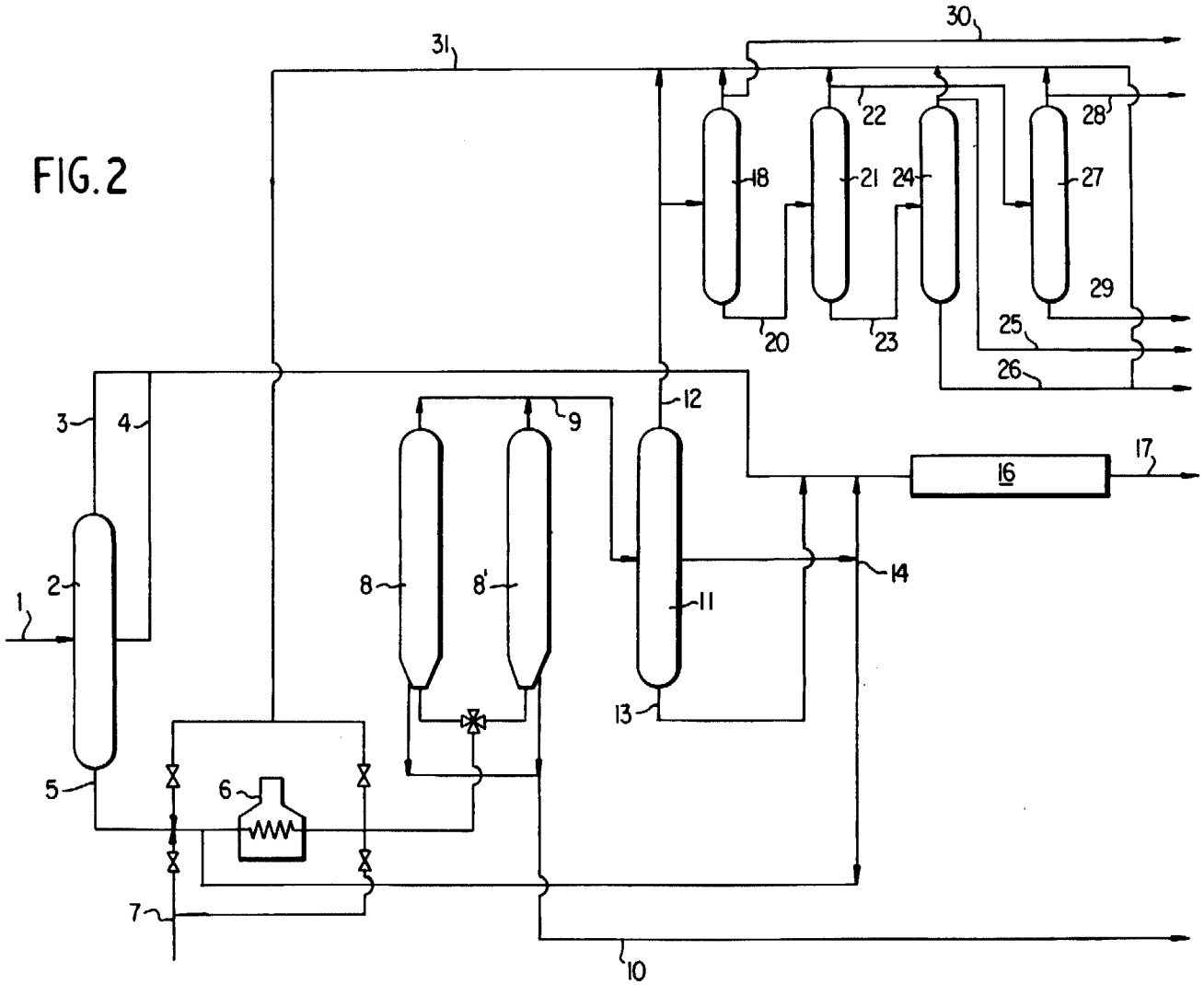
FIG. 2 is a simplified schematic flow diagram of a preferred embodiment of the invention.

The process of the invention can be carried out in a system shown in the flow diagram of FIG. 2. In the gas flow of the coking reaction, it is possible to recycle the thermally cracked gas or the thermally cracked light hydrocarbons as gas sources. Heavy petroleum hydrocarbons such as atmospheric residual oil, vacuum residual oil, thermally cracked oil, catalytically cracked oil and other heavy hydrocarbons such as natural asphalt, coal tar, shale oil, tar sand, and the like can be used as the hydrocarbon source in the process of the invention. The relationship between the cracking of the raw material and the resulting synthetic coking coal is not clear. However, usually when a feed stock having a high content of condensed aromatic ring compounds, is used, a synthetic coking coal having good coking properties can be obtained. Moreover, usually when a feed stock having a high content of conradson carbon is used, the yield of the synthetic coking coal is increased.

The process of the present invention provides a synthetic coking coal which has a higher free swelling index, i.e., better coking properties, in comparison to the synthetic coking coals produced by the conventional processes. The free-swelling index of synthetic coking coal produced by the present invention is the same as natural coking coal. As shown in the following examples, the free swelling index can be as great as 8. The fluidity of the synthetic coking coal obtained by the process of the invention is greater than that of natural coking coal, and the solidification temperature is greater than 500° C. Also, as shown in the following examples, a synthetic coking coal is provided which has a softening temperature of 314° C, a maximum fluidity temperature of 430° C, a maximum fluidity greater than 28,000 ddpm and a solidification temperature of 514° C.

The process of the present invention, also provides a binder pitch which has a desirable softening point, by selecting the appropriate coking conditions.

In addition to the already described advantages of the process of the invention, the process also has the following advantage. As the coking reaction is conducted under reduced partial pressure of the hydrocarbon being coked, the velocity of the flow of gas and the liquid issuing from the reactor is increased and the coking time can be substantially shortened in comparison to the conventional processes. This results in the effective production of synthetic coking coal. Further, a thermally cracked oil can be obtained in high yields, and a low sulfur fuel oil can be easily obtained by the hydrodesulfurization of thermally cracked oil.

The temperature range of the coking reaction of the present invention can be extended to lower temperature than possible in the conventional processes. Also, when a gas or a gas source is admitted to the coking reactor before the inlet of the heating tubes, the linear velocity of the gas flow in the tubes for the supply of the raw material can be increased to prevent the deposition of coke in the tubes.

In an embodiment of the invention, the distilled decomposition oil produced when the coking reaction is conducted under reduced pressure is hydrodesulfurized to yield a low sulfur fuel oil.

In another embodiment of the invention, the distilled cracked oil produced when the coking reaction is conducted in a gas flow is hydrodesulfurized to yield a low sulfur fuel oil.

The heavy distilled oil obtained in high yields by the process of the present invention can also be used as a raw material for lubricant oils having substantial economic value.

The accompanying FIG. 2 is a diagrammatic representation of a series of process steps which show one preferred embodiment of the invention. A virgin reduced crude oil 1 is admitted into a vacuum distillation unit 2 where it is separated into a vacuum gas oil which passes through lines 3 and 4 and a vacuum residual oil which passes through line 5. The vacuum residual oil 5 is heated to a cracking temperature in heater 6 and the cracked oil is supplied to coking drums 8 and 8'. The coking reaction in a gas flow requires the injection of steam, nitrogen and hydrogen through 7, an atmospheric distilled light fraction through line 12 or an atmospheric distilled heavy fraction through 14 at the inlet or outlet of the heater. Whenever necessary, the synthetic coking coal produced in the coking drums 8 and 8' is withdrawn from the bottoms of the coking drums and is used as a coking coal for metallurgical purposes. The effluent 9 from the top of the coking drums is then fed to an atmospheric distillation unit 11 and which effects separation of the oil into a light fraction 12 and the heavy fractions 13 and 14. The distilled light fraction is sent to absorber 18 then through line 20 to debutanizer 21, and through line 23 to naphtha separator 24. Light naphtha and heavy naphta are withdrawn through lines 25 and 26, respectively. The light effluent from the debutanizer is passed to depropanizer 27 via line 22. Propane is withdrawn from the depropanizer by line 28 and butane is withdrawn by line 29. The heavy naphtha withdrawn from the naphtha separator and other light fraction from depropanizer 27, debutanizer 21, absorber 18 and distillation unit 11 can be recycled to heater 6 through line 31. If desired, the light fraction from the absorber unit 18 may be withdrawn through line 30. Thereafter, the treated oil is fed to a depropanizer to effect the separation of the gas into butane, light naphtha and heavy naphtha. The heavy fractions from unit 11 are passed through lines 13 and 14 and are mixed with the vacuum gas oil in lines 3 and 4. The mixed oils are charged to hydrodesulfurization unit 16, whereby a low sulfur fuel oil 17 is produced.

Having generally described this invention, a further understanding can be obtained by reference to certain specific examples which are provided herein for purposes of illustration only and are not intended to be limiting unless otherwise specified.

In the following Examples, the term "ddpm" is the abbreviation for "dial divisions per minute."

The time of the coking reaction is dependent upon the temperature of the coking reactor. FIG. 1 shows the time-temperature relationship for the process of the present invention. As can be seen, the reaction time for the coking process varies from about ½ hour to about 4 hours at 500° C to about from 14 hours to about 36 hours at 380° C. At a temperature of 410° C, the reaction time is from about 2 hours to about 25 hours while at 490° C, the reaction time is about ½ hour to about 6 hours. The time of reaction for any particular temperature can be readily determined by reference to FIG. 1.

EXAMPLE 1

A vacuum residual oil derived from Kuwait crude oil with a softening point of 39° C, a penetration value of 218 (25° C), a Conradson carbon content of 17.5 weight %, a vanadium content of 110 ppm and a sulfur content of 5.0 weight % was used as a feed stock. The coking reaction was conducted for 10 kg of the feed stock introducing nitrogen at a rate of 135 l/hr - kg feed stock (Standard Temperature and Pressure) at the bottom of an autoclave having an inner volume of 20 liters at 420° C at atmospheric pressure for 3 hours. The yield of coke was 30% based on the amount of vacuum residual oil. The free swelling index of the "synthetic coking coal" was 8 and the volatile matter (JIS M8812-1972) was 27.5%.

A test was also conducted on the synthetic coking coal by the method described in "Plastic Properties of Coal by the Gieseler Plastometer." This test gave the following values for coal: a softening point of 314° C; a maximum fluidity temperature of 430° C; a maximum fluidity above 28,000 ddpm and a solidification temperature of 514° C. A box test (JIS M8801-1972) was conducted on the synthetic coking coal in which the amount of synthetic coking coal was 7 wt% on the total blend. The results gave a Drum Index, $DI_{15}^{30}$ (JIS K2151-1972) of 93.2 compared to $DI_{1530}$ value of 92.9 for a standard blend. These results are shown in Table 1.

EXAMPLE 2

The feedstock in this case was a thermally cracked fuel oil, which was a by-product of a naphtha cracking process (boiling point above 350° C). According to the prodedure of Example 1, the feedstock underwent coking reaction at 430° C at atmospheric pressure, introducing nitrogen 15 l/hr - kg feedstock for 3 hours.

EXAMPLE 3

In this example, a feedstock of a vacuum residual oil from Agha Jari crude oil with a softening point of 38° C, a penetration (25° C) value of 252 and a Conradson carbon content value of 14.3 wt% was used. Following the procedure of Example 1, the reaction was carried out at 430° C at atmospheric pressure introducing 334 gr/hr - kg feedstock of kerosene having an average molecular weight of 186 (equivalent to about 40 l/hr - kg feedstock at standard temperature and pressure) for 3 hours. The results are shown in Table 1.

EXAMPLE 4

The feedstock of Example 3 was treated by the procedure of Example 1. The reaction was conducted at 420° C with injection of water at a rate of 100 gr/hr - kg feedstock (equivalent to 124 l/hr - kg feedstock) for 4 hours under atmospheric pressure. The results are shown in Table 1.

EXAMPLE 5

The same feedstock as employed in Example 1 was used. The feedstock was pumped to a heater at a rate of 400 gr/hr where it was heated to 420° C. The heated feedstock was fed into a coking drum with an inner volume of 2 liters whose skin temperature was maintained at 420° C. The coking reaction was conducted at a pressure of 200 mm of mercury (absolute). The results are shown in Table 1. The yield of the distillate produced was 65%, and 85 wt% of the distillate (55 wt% based on the feedstock) was the fraction with a boiling point above 300° C. The properties of the distillate are shown in Table 2.

EXAMPLE 6

In this example, the feedstock used was a mixture of 50 wt% of a vacuum residual oil from Kuwait crude oil (same as employed in Example 1) and 50 wt% of a gas oil having an average molecular weight of 230 and an end point (ASTM D86) of 350° C. The volume of the vaporized gas oil is equivalent to 97 l/hr-kg of vacuum residual oil (Standard Temperature and Pressure). The feedstock was heated and charged to a coking drum with an inner volume of 20 liters whose skin temperature was maintained at 415° C. The coking reaction was conducted at a pressure of 500 mm of mercury (absolute) for 8 hours.

The properties of the distillate are shown in Table 2. The properties of the synthetic coking coal are shown in Table 1. A fraction having a boiling point about 300° C and having a sulfur content of 3.2 wt% was hydrodesulfurized over a catalyst of 2.8 wt% cobalt and 9.4 wt% molybdenum with a volume of 100 cc in a down flow reactor with an initial reaction temperature of 380° C, a hydrogen pressure of 50 kg/cm² (Gauge) and a space velocity of 1 v/v/hr. The hydrodesulfurization reaction resulted in the recovery of a desulfurized oil having a 0.32 wt% sulfur content (90% desulfurization). The incremental increase in the reaction temperature under these conditions to obtain a 90% desulfurization was 0.1° C/day in a continuous operation of 100 days.

EXAMPLE 7

A feedstock of a vacuum residual oil from Agha Jari crude oil (specific gravity 25/25° C of 1.0038 and Conradson Carbon content of 15.8 wt%) was heated at 150° C and was fed at a rate of 50 kg/hr with a steam feedrate of 12 kg/hr, to the coking drum. They were heated in an oven so as to maintain the temperature of the coking drum at 405° C. The synthetic coking coal is retained in the coking drum and the light hydrocarbons produced by cracking were discharged from the coking drum and recovered. The feed of heated heavy hydrocarbons to the coking drum was continued for 21 hours. Then a light oil was fed at a rate of 50 kg/hr for 2 hours to remove the unreacted material and any light hydrocarbons retained in the coking drum. The synthetic coking coal product was then discharged from the coking drum. The results are shown in Table 1.

TABLE 1

Coking Conditions and Properties of "Synthetic Coking Coal"

| No. | Example 1 | 2 | 3 | 4 | 5 | 6 | 7 | Reference 1 |
|---|---|---|---|---|---|---|---|---|
| Gas or liquid injected | N2 | N2 | Kerosene | Water | None | Gas Oil | Steam | None |
| Flow rate | 135 l/hr-kg feed-stock | 15 l/hr kg feed-stock | 334 gr/hr kg feed-stock | 100 gr/hr-kg feed-stock | 0 | 97 l/hr.* kg feed-stock | 0.24 kg/hr . kg feedstock | 0 |
| Temperature (° C) | 420 | 430 | 430 | 425 | 420 | 415 | 405 | 420 |
| Pressure (mm Hg) | 760 | 860 | 760 | 760 | 200 | 500 | 760 | 760 |
| Partial pressure of cracking product (mm Hg) | 170 | 600 | 380 | 150 | — | 280 | 200 | — |
| Reaction period (hour) | 3 | 3 | 3 | 4 | 4 | 8 | 21 | 5 |
| Feedstock | Vacuum residual oil of Kuwait | Thermally cracked oil | Vacuum residual oil of Agha-Jari | Vacuum residual oil of Agha-Jari | Vacuum residual oil of Kuwait | Vacuum residual oil of Kuwait | Vacuum residual oil of Agha-Jari | Vacuum residual oil of Kuwait |
| Coke Yield (wt%) | 30 | 28 | 22 | 20 | 29 | 32 | 30.1 | 35 |
| Volatile matter (wt%) | 27.5 | 23.8 | 26.3 | 24.0 | 24.6 | 32.5 | 28.0 | 24.8 |
| Free swelling index | 8 | 8 | 6½ | 5½ | 7½ | 6 | 5 | 0 |
| Softening temperature (° C) | 314 | 302 | 308 | 318 | 312 | below 300 | below 300 | 314 |
| Maximum fluidity temperature (° C) | 430** | 420** | 420** | 452 | 420** | 420** | 418 | 442 |
| Maximum fluidity (ddpm) | above 28,000 | above 28,000 | above 28,000 | 18,000 | above 28,000 | above 28,000 | above 28,000 | 18,000 |
| Solidification temperature (° C) | 514 | 552 | 512 | 508 | 510 | 519 | 499 | 502 |
| Coke strength*** (DI$^{15}_{150}$) | 93.2 | 93.7 | 92.8 | 92.3 | 93.5 | 92.8 | 93.0 | — |

*Gas volume at standard temperature and pressure assuming that the gas oil has an average molecular weight of 230.
**Maximum fluidity temperature: estimated value
***Coke strength: the test was run on the coke obtained from the box test (JIS M8801-1972) A portion of a natural Japanese coking coal (15 wt% in a standard blend) was substituted for the coking coal (7 wt% in the test blend).

TABLE 2

Properties of the Distillate

| No. | Example 5 | 6 | Reference 1 |
|---|---|---|---|
| Reaction Temperature (° C) | 420 | 415 | 420 |
| Pressure (mm Hg abs.) | 200 | 500 | 760 |
| Reaction Period (hrs.) | 4 | 8 | 5 |
| Gas or liquid injected | None | Gas Oil | None |
| Amount of gas or liquid injected (l/hr per kg of feedstock) | 0 | 97* | 0 |
| Feedstock | Vacuum residual oil of Kuwait | Vacuum residual oil of Kuwait | Vacuum residual oil of Kuwait |
| Distillate yield (wt%) | 65 | 62 | 55 |
| Distillation: | | | |
| A) IBP-300° C (wt%) | 15.1 | 20.5 | 55.2 |
| B) 300-425° C (wt%) | 33.7 | 34.0 | 27.4 |
| C) 425° C (wt%) | 51.4 | 45.5 | 17.4 |
| B) + C) | | | |
| Sulfur (wt%) | 3.3 | 3.2 | 3.2 |
| Asphaltene (wt%) | 0 | 0 | 0 |
| Vanadium (ppm) | 0.1 | 0.0 | 0.0 |

*Gas volume at standard temperature and pressure assuming that the gas oil has an average molecular weight of 230.

As can be seen from the results shown in Table 1, operating the coking drum at a reduced partial pressure of the cracking product produces a synthetic coke which has a free-swelling index greater than 4 (the same as natural coking coals), good fluidity and excellent coking strength. It is believed that reducing the partial pressure of the cracking products retains the volatile material in the synthetic coking coal produced. In this manner the free swelling is dramatically improved compared with the method of the prior art (Reference 1). The importance of these results is the fact that coking coal produced by the present invention can be used as a source of the coal required to produce blast furnace coke.

Having now fully described the invention, it will be apparent to one or ordinary skill in the art that many changes and modifications can be made thereto without departing from the spirit or scope of the invention as set forth herein.

What is claimed as new and intended to be covered by letters patent is:

1. A process for producing synthetic coking coal which comprises delayed coking a heavy hydrocarbon oil by:

heating said heavy hydrocarbon oil in a furnace to a coking temperature of from about 380° to about 500° C and sufficient to initiate cracking;

then introducing the heated heavy hydrocarbon oil into a coking drum;

maintaining the heavy hydrocarbon oil in said coking drum for a time ranging from ½ to about 36 hours at said coking temperatures to effect coking thereof;

introducing a diluent gas into the body of said hydrocarbon oil in the coling drum at a flow rate greater than 5 l/hr kg of heavy hydrocarbon oil to maintain the partial vapor pressure of the cracking product vapor over said heavy hydrocarbon oil in said coking drum at about 50 to about 600 mm Hg during said coking;

and recovering a synthetic coking coal having a free-swelling index greater than 4 and containing 20–40 wt.% volatile matter.

2. The process of claim 1, wherein said diluent gas is an inert gas.

3. The process of claim 1, wherein said diluent is a hydrocarbon.

4. The process of claim 1, wherein the partial pressure of said cracking product is from 50 to 500 mm Hg.

5. The process of claim 1, wherein the temperature is from 400° - 460° C.

6. The process of claim 1, wherein said diluent gas is fed at a rate of from 30 to 500 l/hr.kg of heavy hydrocarbon.

7. The process of claim 1, wherein the coking time is as is set forth in FIG. 1.

8. The process of claim 1, wherein said diluent gas is introduced into the coking drum with the heavy hydrocarbon oil.

9. The method of claim 8, wherein the diluent gas is introduced into the heavy hydrocarbon oil before it is heated in the furnace to a temperature sufficient to initiate cracking.

* * * * *